US011512468B2

(12) United States Patent
Szymanski

(10) Patent No.: US 11,512,468 B2
(45) Date of Patent: Nov. 29, 2022

(54) TRUSS BRACING SYSTEM

(71) Applicant: Steve J. Szymanski, Pulaski, WI (US)

(72) Inventor: Steve J. Szymanski, Pulaski, WI (US)

(73) Assignee: Truss Brace Solutions, LLC, Pulaski, WI (US)

( * ) Notice: Subject to any disclaimer, the term of this patent is extended or adjusted under 35 U.S.C. 154(b) by 0 days.

(21) Appl. No.: 17/208,742

(22) Filed: Mar. 22, 2021

(65) Prior Publication Data

US 2022/0298791 A1 Sep. 22, 2022

(51) Int. Cl.
*E04C 3/04* (2006.01)
*E04C 3/02* (2006.01)

(52) U.S. Cl.
CPC ..... *E04C 3/04* (2013.01); *E04C 2003/026* (2013.01); *E04C 2003/0486* (2013.01)

(58) Field of Classification Search
CPC ..... E04C 3/04; E04C 2003/026; E04C 3/18; E04C 2003/0486; E04B 1/2608; E04B 2001/2616; E04B 2/765; E04B 2/763
See application file for complete search history.

(56) References Cited

U.S. PATENT DOCUMENTS 2,617,154 A * 11/1952 St Cyr ..... E04C 3/02 52/695
2,856,646 A * 10/1958 Latimer ..... E04B 2/706 52/657
2,865,059 A * 12/1958 Scriven ..... E04C 3/02 52/695
4,604,845 A * 8/1986 Brinker ..... E04B 1/2604 52/696
7,428,804 B2 * 9/2008 Surowiecki ..... E04B 2/7457 52/656.1
9,022,335 B2 * 5/2015 Randazzo ..... F16M 13/022 248/288.11
9,085,888 B2 * 7/2015 Fuller ..... E04G 25/00
10,233,632 B1 * 3/2019 Wokutch ..... E04B 1/2604
2004/0231274 A1 * 11/2004 Engstrom ..... E04B 2/767 52/634
2013/0161467 A1 * 6/2013 Randazzo ..... F16M 13/022 248/288.11

(Continued)

FOREIGN PATENT DOCUMENTS

GB 2086519 A * 5/1982 ..... F16B 5/02
GB 2436748 A * 10/2007 ..... E04B 2/7457
WO WO-2019123388 A1 * 6/2019 ..... E04B 1/40

*Primary Examiner* — Theodore V Adamos
(74) *Attorney, Agent, or Firm* — Ruder Ware, L.L.S.C.

(57) ABSTRACT

A truss bracing system for roof trusses is disclosed. The truss bracing system comprises of a lateral brace and a diagonal brace connected through a pivot point. Both the lateral brace and diagonal brace include a first support member and a second support member where the first support member is angled relative to, and preferably perpendicular to, the second support member. The pivot point allows the diagonal brace to rotate relative to the lateral brace. That is, the truss bracing system has a closed configuration with the diagonal brace resting adjacent and parallel to the lateral brace and an extended configuration with the diagonal brace rotated relative to the lateral brace, such that the diagonal brace is angled relative to the lateral brace. Thus, the truss bracing system provides both lateral and diagonal support to the trusses to which it is attached.

20 Claims, 7 Drawing Sheets

(56) References Cited

U.S. PATENT DOCUMENTS

| | | | | |
|---|---|---|---|---|
| 2016/0024791 | A1* | 1/2016 | Reno | E04C 3/02<br>52/745.21 |
| 2017/0167160 | A1* | 6/2017 | Beisser, III | E04H 17/266 |
| 2019/0242111 | A1* | 8/2019 | LeBlang | E04C 3/32 |

* cited by examiner

TRUSS BRACING SYSTEM

BACKGROUND OF THE INVENTION

The invention disclosed herein relates to a truss bracing system and, more specifically, a truss bracing system that includes integral lateral and diagonal braces such that both lateral and diagonal bracing may be accomplished through the use of one integrated system.

The construction of wood frame buildings, such as residential homes, multifamily homes, commercial buildings, and other similar such buildings, or other buildings having a wood frame roof typically involves the installation of pre-made trusses as part of the roof system for the building. The trusses are lifted on top of the frame of the building and then secured to the frame with fasteners, typically nails, by driving the fasteners through the base of the truss and into the frame of the building. Once the trusses have been mounted on the frame of the building, but before the plywood roof sheathing has been installed, the truss lacks lateral support for the upper portions of the truss (for example, near where the peak of the roof will be) since only the base of the truss is secured to the frame of the building. Therefore, the builder must install truss bracing due to safety and building code requirements to provide such lateral and diagonal support to the trusses until the plywood roof sheathing has been installed. Such bracing prevents the trusses from falling over (and potentially creating a domino effect with other trusses) due to wind, other construction activities, or other events that may result in lateral forces acting upon the truss, thereby providing safety to the individuals working on the building and avoiding potential damage to the frame of the building which may result from the trusses falling over.

Currently, the braces take a variety of forms. The most basic form of the braces comprises of wood boards, such as standard construction two-by-fours, mounted on the trusses. The boards used are either waste material from the construction of the building frame or extra boards that have been cut into shorter lengths. The boards are cut to the desired length and then are mounted to the trusses—one set of boards are mounted laterally and another set of boards are mounted diagonally. The boards are left in place until the plywood roof sheathing is ready to install and then, since the boards would otherwise interfere with the installation of the roof sheathing, the boards must be completely removed as the roof sheathing is installed.

There are also a variety of commercial bracing options which seek to provide products that have benefits over using simple boards as the bracing. One commercial product is The Stabilizer™ Truss Brace and Spacer by MiTek, Inc., which provides a lateral truss brace. The product comprises a sheet metal brace that runs from one truss to the next, with sidewalls extending downward from each edge of the brace to provide additional strength. Both the brace and the sidewall include tabs on each end with metal teeth that are driven into the two trusses to secure the brace. Due to the low profile of the product, it may be left in place when the roof sheathing is installed, as it does not interfere with the installation of the roof sheathing. However, this brace provides only the lateral bracing structure—no diagonal bracing is provided so that some other form of separate diagonal bracing (such as the use of simple boards for diagonal bracing) must be used to provide the necessary diagonal bracing for the trusses.

Another example of a commercially available brace is the TSBR Truss Spacer-Restraint by Simpson Strong-Tie Company, Inc. This brace is quite similar to The Stabilizer™ Truss Brace and Spacer discussed above, with a sheet metal brace that runs from one truss to the next, with sidewalls extending downward from each edge of the brace to provide additional strength. Both the brace and the sidewall include tabs on each end. The ends of the brace include apertures for receiving fasteners for securing the brace to the trusses to which it is to be attached, while the ends of the sidewalls only rest against the sides of the trusses without further attachment. Similar to above, due to the low profile of the product, it may be left in place when the roof sheathing is installed, as it does not interfere with the installation of the roof sheathing. However, this brace again provides only the lateral bracing structure—no diagonal bracing is provided so that some other form of separate diagonal bracing (such as the use of simple boards for diagonal bracing) must be used to provide the necessary diagonal bracing for the trusses.

Yet another commercially available solution is the TrussLox® Spreader Bar temporary bracing system by TrussLox, LLC. The TrussLox® system comprises a plastic bar with a pair of slots or channels for receiving the two trusses to which it is to be attached. The bar is placed over the two trusses with the trusses just below the corresponding slot or channel and then pushed downward into place, forming a lateral brace between the two trusses. Then, when the builder is ready to install the roof sheathing, the bar is pulled upward off of the trusses and the sheathing material is secured to the trusses. However, again, this brace provides only the lateral bracing structure—no diagonal bracing is provided so that some other form of separate diagonal bracing (such as the use of simple boards for diagonal bracing) must be used to provide the necessary diagonal bracing for the trusses. Additionally, since the bar must be removed before the roof sheathing is installed, because it would interfere with the installation of the sheathing material, the trusses lose their lateral support prior to the sheathing being installed.

Thus, while there are a variety of existing options or solutions for the lateral bracing of trusses, none of the available products include diagonal bracing support. In each case, the diagonal bracing must be provided by separate means or separate components. Therefore, there is a need for a product that includes both lateral and diagonal bracing in a single component, such that both lateral and diagonal bracing may be accomplished through the use of one integrated system. The present invention provides for such an integrated system, while providing the additional benefit that the bracing may be left in place when the roof sheathing is installed, providing additional strength to the roof and greater safety for the individuals installing the roof sheathing.

BRIEF SUMMARY OF THE INVENTION

It is a feature of the present invention to provide a truss bracing system with integral lateral and diagonal braces and which may be folded into a single lateral component for sale and storage prior to use.

The truss bracing system of the present invention comprises of a lateral brace and a diagonal brace connected through a pivot point.

The lateral brace includes a first support member and a second support member. Preferably, the first support member and a second support member are integral to each other. That is, preferably, the lateral brace is an integral component with the first support member angled relative to the second support member. Most preferably, to provide the lateral brace with the greatest level of strength and durability, the first support member and the second support member are perpendicular to each other.

Generally the second support member is shorter in length than the first support member, such that the second support member falls between the two trusses to which the truss bracing system is to be attached, while the first support member extends over the top of the truss to allow the lateral brace (and truss bracing system) to be secured to the truss.

The lateral brace also includes an end stop at a first end of the lateral brace which extends downward from the first support member perpendicular to both the first support member and the second support member. The end stop provides additional support to the truss bracing system by resting against the outer surface of the truss and providing additional lateral support to the truss bracing system when it is subjected to lateral forces.

There is a gap between the end stop and the end of the second support member, such that the truss may extend through such gap with the first support member resting on top of the truss and the end stop adjacent to the outer surface of the truss.

The first end of the lateral brace includes an aperture and a second end of the lateral brace opposite the first end also includes an aperture for receiving fasteners for securing the lateral brace and the truss bracing system to the trusses to which it is secured. Typically, the fasteners take the form of nails, but any type of fastener known in the art may alternatively be used to secure the lateral brace and the truss bracing system to the truss.

The lateral brace also includes a pivot aperture for receiving the pivot point of the truss bracing system. The pivot aperture is located along the longitudinal centerline of the first support member, between the two ends of the lateral brace. The specific longitudinal location of the pivot aperture is selected based upon the length of diagonal brace used and the desired angle between the lateral brace and the diagonal brace.

The diagonal brace includes a first support member and a second support member. Preferably, the first support member and a second support member are integral to each other. That is, preferably, the diagonal brace is an integral component with the first support member angled relative to the second support member. Most preferably, to provide the diagonal brace with the greatest level of strength and durability, the first support member and the second support member are perpendicular to each other.

Generally the second support member is shorter in length than the first support member, such that the second support member ends adjacent to the truss to which the truss bracing system is to be attached, while the first support member extends over the top of the truss to allow the diagonal brace (and truss bracing system) to be secured to the truss.

The diagonal brace also includes a pivot aperture for receiving the pivot point of the truss bracing system. The pivot aperture is located near a first end of the first support member of the diagonal brace along the longitudinal centerline of the first support member.

The diagonal brace also includes an end stop at a second end of the diagonal brace opposite the first end which extends downward from the first support member perpendicular to the first support member and at an angle to the second support member. The end stop provides additional support to the truss bracing system by resting against the outer surface of the truss.

There is a gap between the end stop and the end of the second support member, such that the truss may extend through such gap with the first support member resting on top of the truss and the end stop adjacent to the outer surface of the truss.

The second end of the diagonal brace includes an aperture for receiving a fastener for securing the diagonal brace and the truss bracing system to the truss to which it is secured. Typically, the fastener takes the form of a nail, but any type of fastener known in the art may alternatively be used to secure the diagonal brace and the truss bracing system to the truss.

Both the first end and second end of the diagonal brace have an angled configuration relative to the sides of the diagonal brace. The first end of the diagonal brace has an angle that corresponds with the surface of the second support member of the lateral brace when the diagonal brace is in its extended, ready-to-use configuration. Likewise, the second end of the diagonal brace has an angle that corresponds with the outer surface of the truss to which the truss bracing system will be secured when the diagonal brace is in its extended, ready-to-use configuration. Preferably, to allow the diagonal brace to smoothly rotate from its closed storage configuration to its extended, ready-to-use configuration, the angled second end of the first support member curves into the straight edge of the first support member.

The lateral brace and diagonal brace are secured to each other through a pivot point, which allows the diagonal brace to rotate relative to the lateral brace. That is, when the truss bracing system of the present invention is being shipped, sold, or stored, or in any situation where the space taken up by the truss bracing system is desired to be minimized, the truss bracing system may be held in its storage configuration with the diagonal brace rotated such that it is adjacent to, and parallel with, the lateral brace. Then, when the truss bracing system of the present invention is to be installed to provide bracing to trusses, it is shifted to its extended configuration with an end of the diagonal brace rotated outward and away from the lateral brace to provide the desired diagonal bracing, such that the diagonal brace is angled relative to the lateral brace.

The pivot point of the truss bracing system extends through the pivot aperture of the lateral brace and the pivot aperture of the diagonal brace. Preferably, the pivot point comprises a short metallic cylinder that is extended through the pivot aperture of the lateral brace and the pivot aperture of the diagonal brace and then compressed flat to secure the diagonal brace to the lateral brace while still allowing the diagonal brace to rotate relative to the lateral brace. However, alternatively, the pivot point may take the form of any type of pivot known in the art, such as a rivet, pivot pin, or other similar fastener without departing from the scope of the present invention.

To use the truss bracing system of the present invention, the end user first extends the diagonal brace to its open, ready-to-use configuration from its closed storage configuration adjacent to the lateral brace, such that the diagonal brace is angled relative to the lateral brace. The lateral brace of the truss bracing system is then placed over two adjacent trusses, with the end stop of the lateral brace resting adjacent to the outer surface of the first truss and the first support member of the lateral brace resting on top of the first and second trusses (and with the second support member of the lateral brace extending between the first and second trusses). At the same time, the diagonal brace of the truss bracing system is placed over the second truss, with the end stop of the diagonal brace resting adjacent to the outer surface of the second truss and the first support member of the diagonal brace resting on top of the second truss (and with the second support member of the diagonal brace extending between the second brace and the second support member of the lateral brace). The truss bracing system is then secured to the first and second trusses by extending nails, or other fasteners, through the fastener apertures of the lateral brace and the fastener of the diagonal brace and into the wood of the trusses.

Thus, the truss bracing system of the present invention provides both lateral and diagonal support to the trusses through an integral, one-piece component, thereby replacing the multiple components needed to supply such support in the prior art. Additionally, the truss bracing system of the present invention is a low profile system that allows the roofing material (such as plywood sheeting) to be installed directly over the truss bracing system, avoiding the need to remove the bracing for the trusses as the roofing material is installed and therefore providing additional strength and support to the truss while the roofing material is being installed over the trusses. This both saves time and provides greater safety when the truss bracing system of the present invention is used in comparison to prior art products and procedures. Finally, due to the greater strength of the truss bracing system of the present invention in comparison to prior art products and procedures, it is believed that fewer truss bracing system components can be used to provide the necessary strength and safety support to the trusses of a complete roof system.

Thus, the present invention provides a truss bracing system with integral lateral and diagonal braces which provides both lateral and diagonal bracing while still allowing the truss bracing system to be folded into a single lateral component for sale or storage prior to use.

BRIEF DESCRIPTION OF TH E DRAWINGS

DETAILED DESCRIPTION OF THE PREFERRED EMBODIMENT(S)

The present invention provides a truss bracing system with integral lateral and diagonal braces and which may be folded into a single lateral component for sale and storage prior to use.

Figure 1:
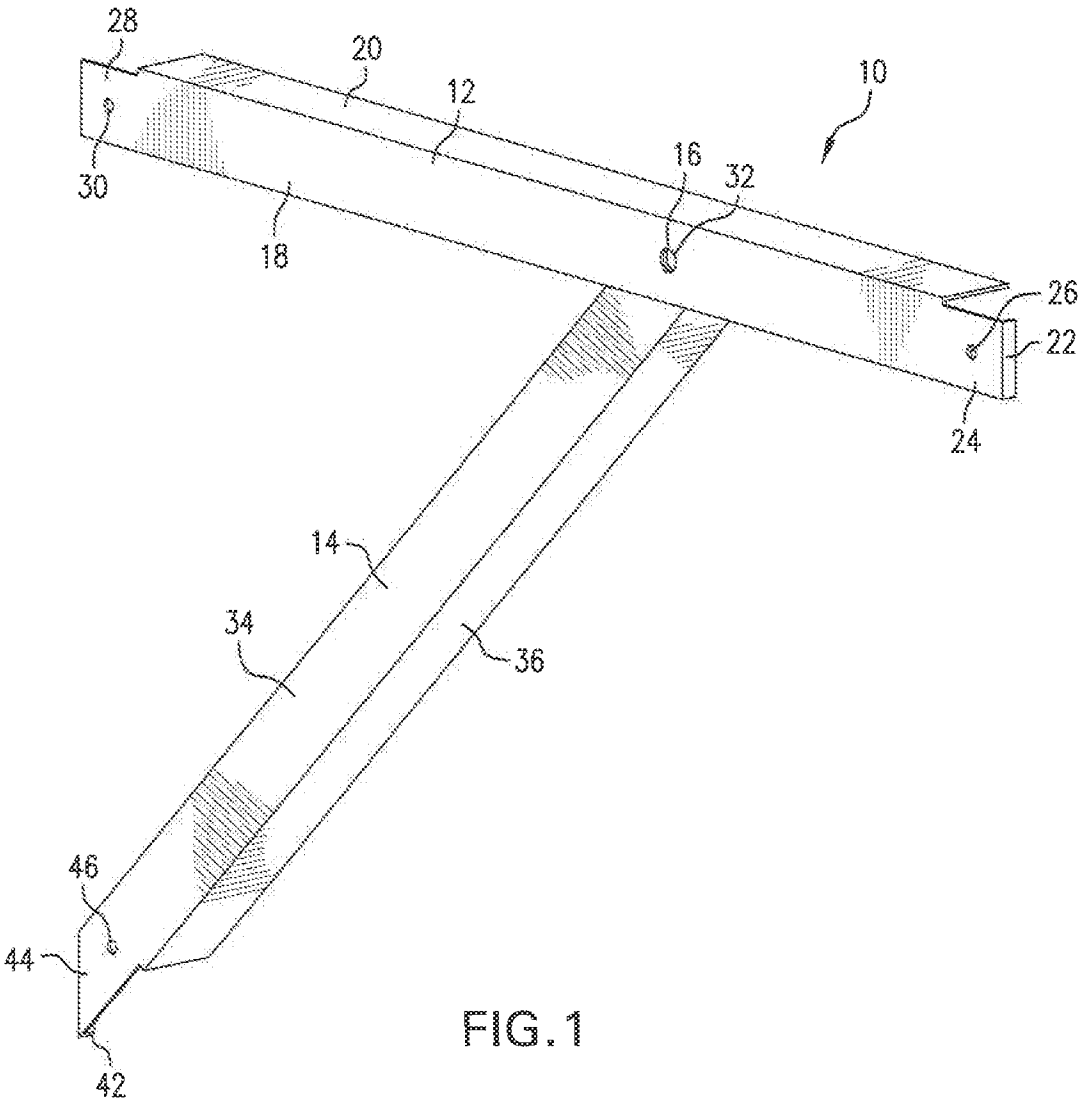
FIG. 1 shows a perspective view of the truss bracing system of the present invention in its unfolded "ready to use" configuration.
Figure 2:
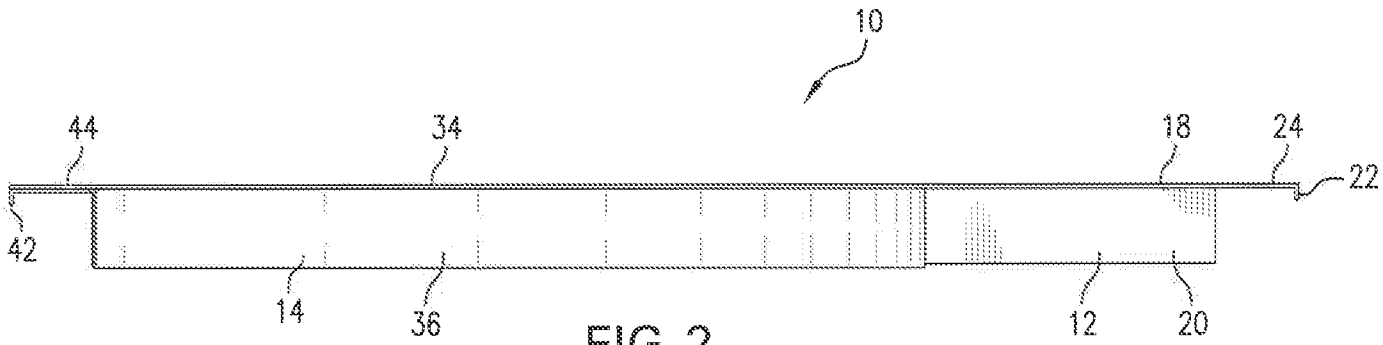
FIG. 2 shows a front plan view of the truss bracing system of the present invention of FIG. 1.
Figure 3:
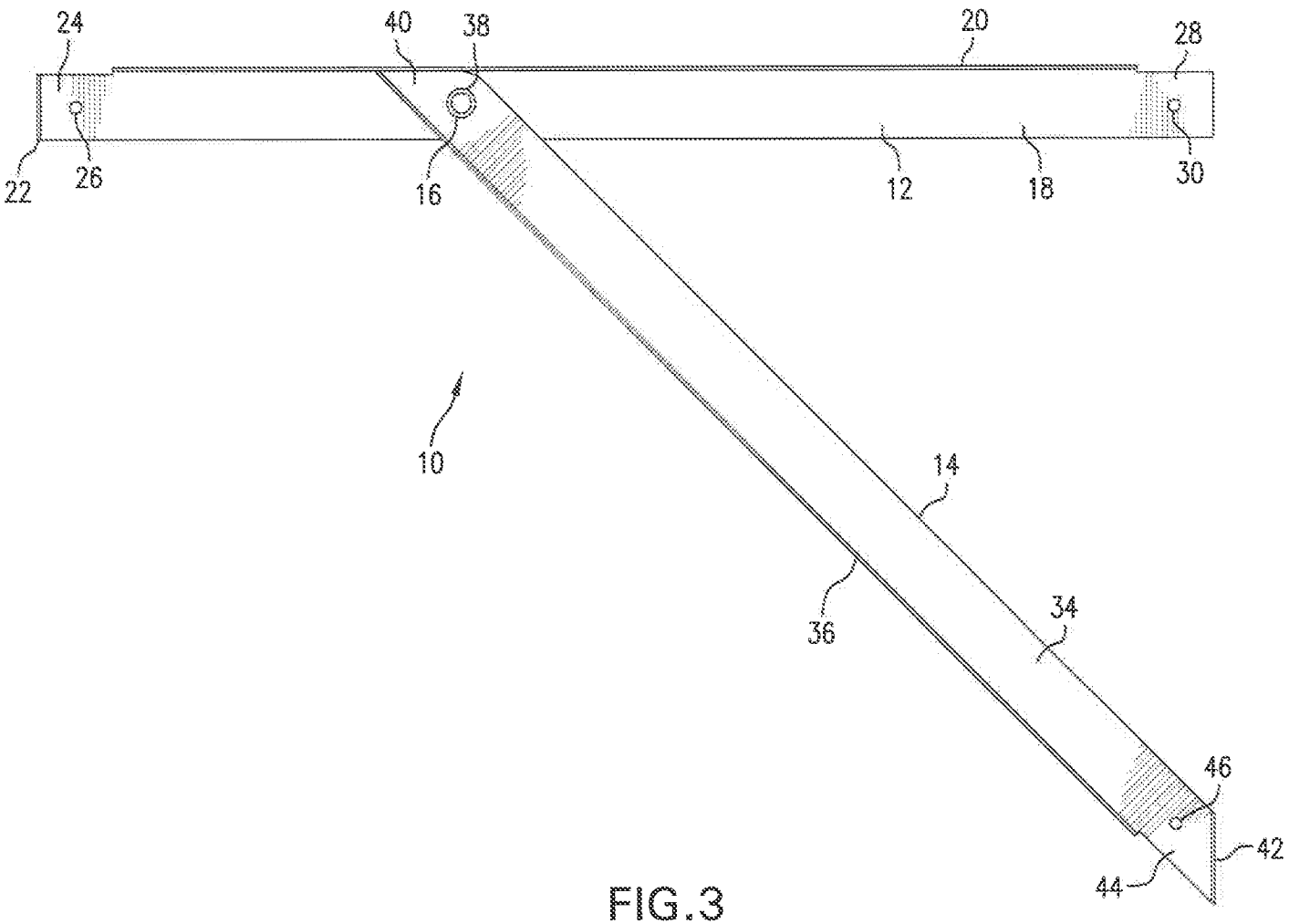
FIG. 3 shows a bottom elevation view of the truss bracing system of the present invention of FIG. 1.
Figure 4:
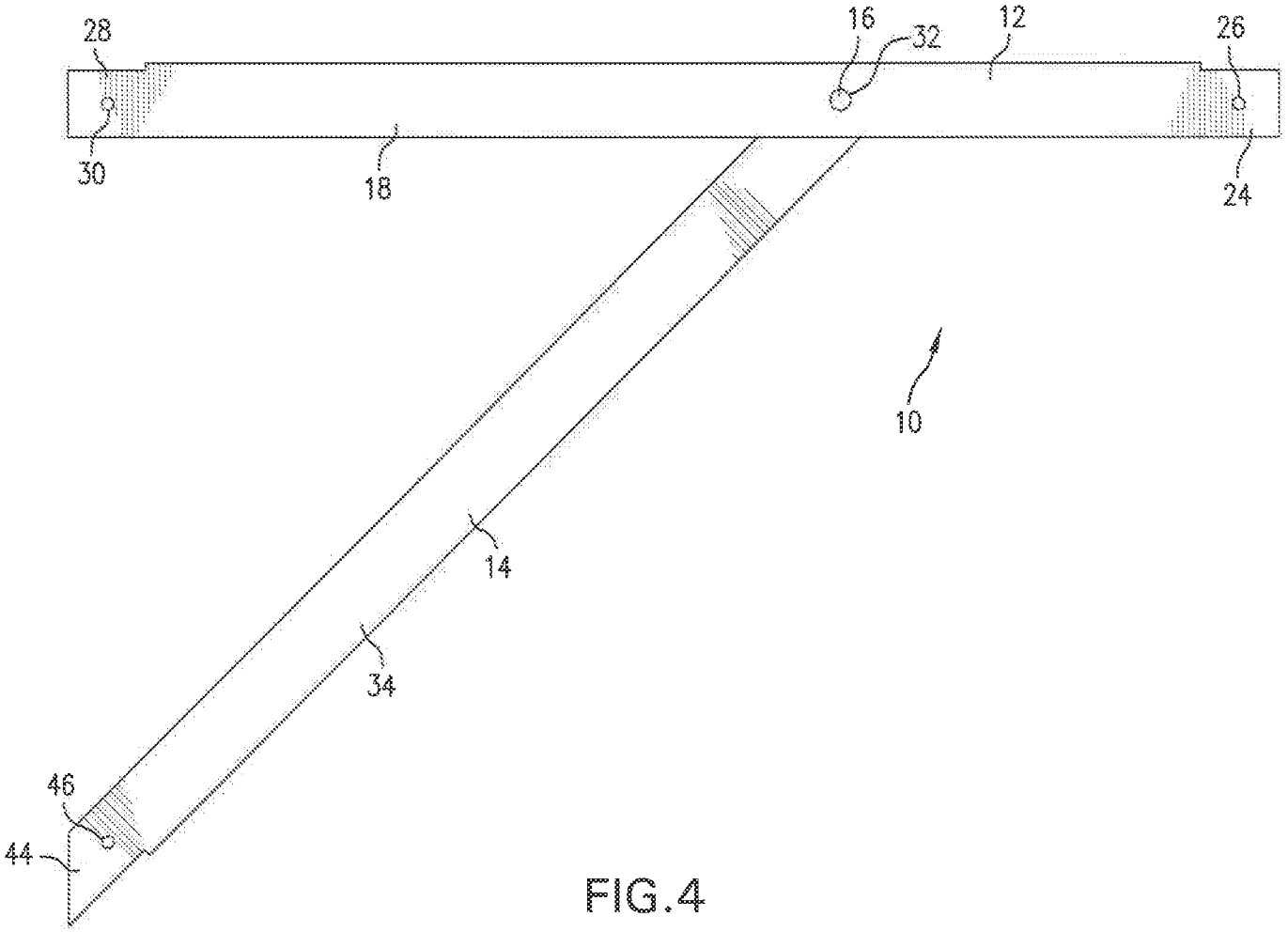
FIG. 4 shows a top elevation view of the truss bracing system of the present invention of FIG. 1.
Figure 5:
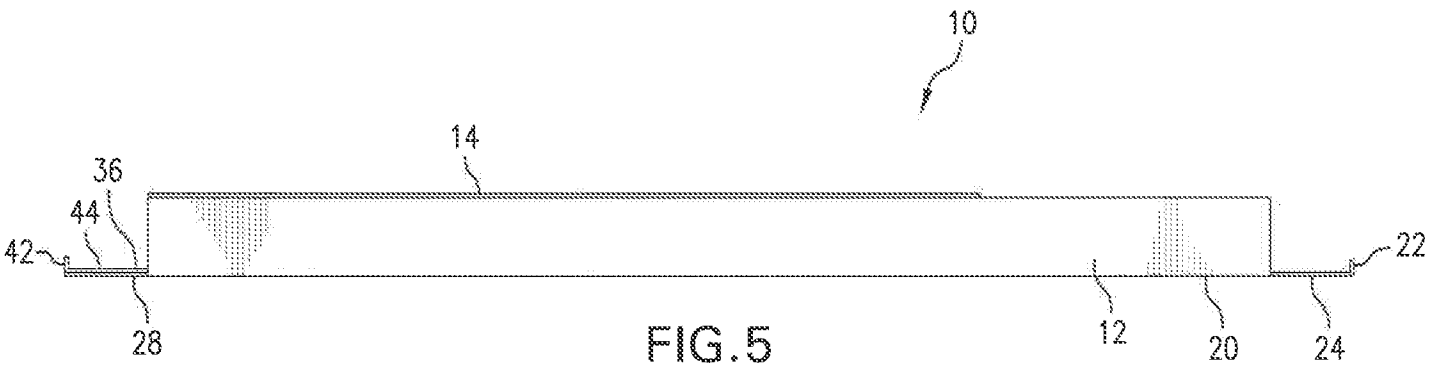
FIG. 5 shows a back plan view of the truss bracing system of the present invention of FIG. 1.
Figure 6:
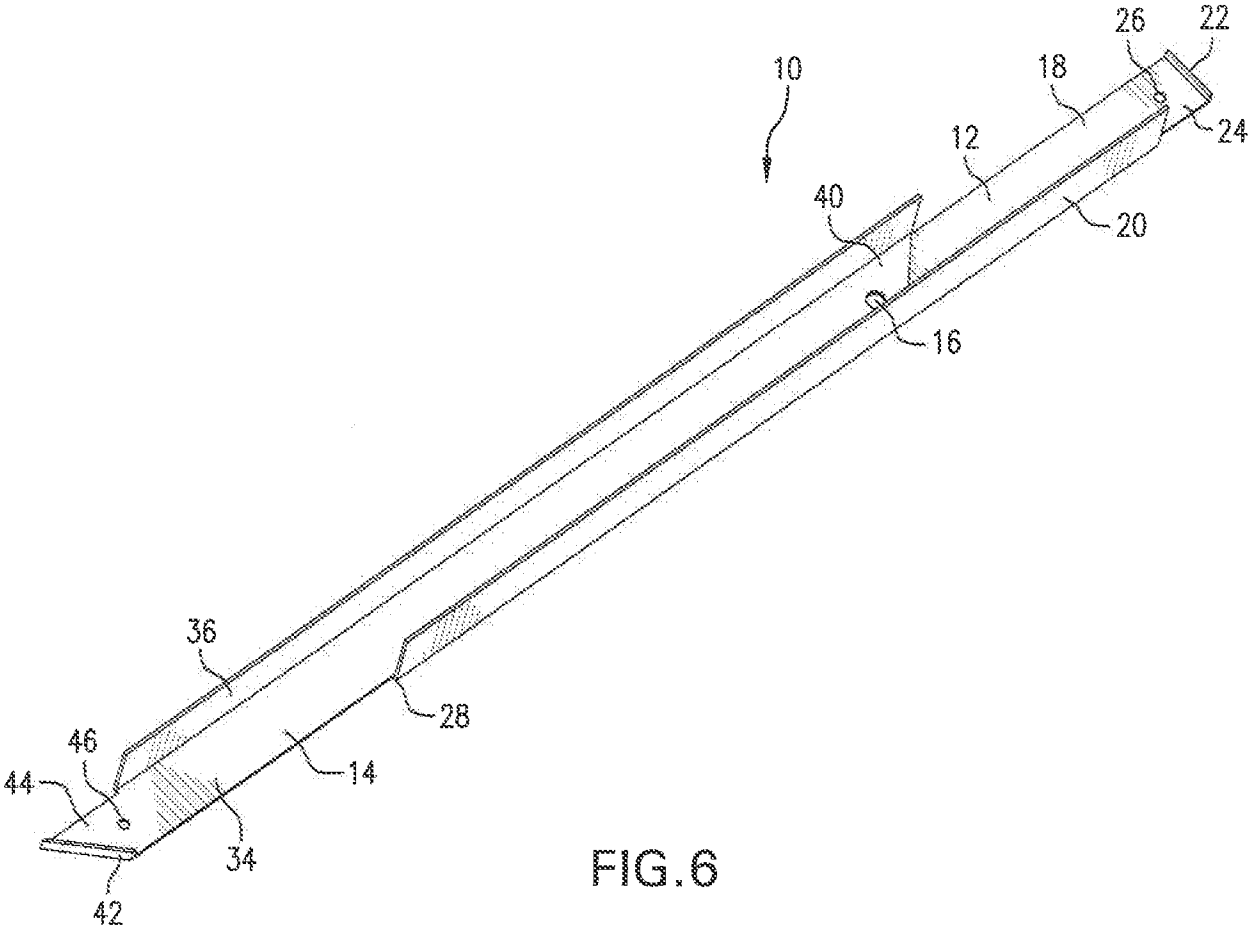
FIG. 6 shows a perspective view of the truss bracing system of the present invention of FIG. 1 in its folded configuration.
Figure 7:
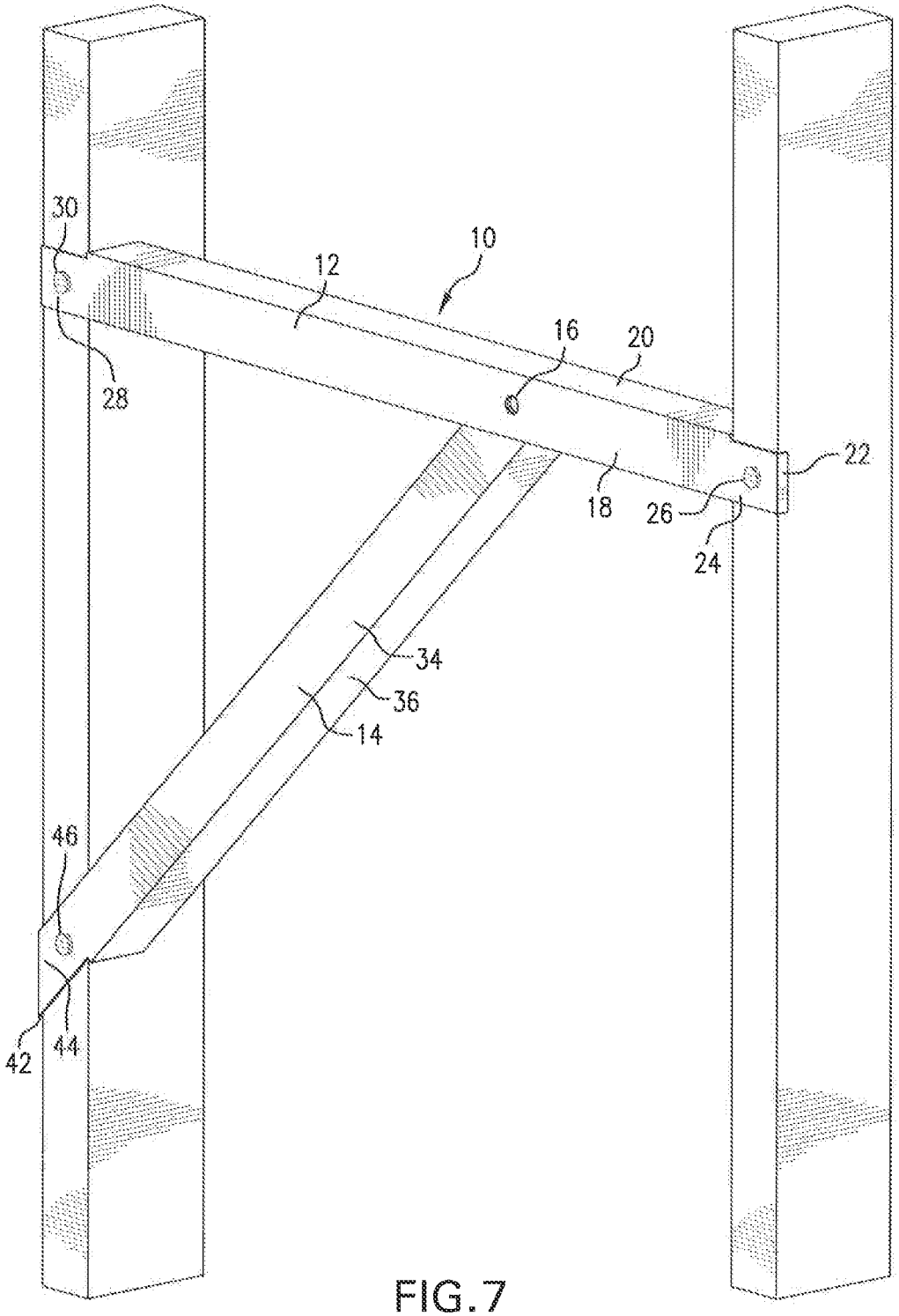
FIG. 7 shows a perspective view of the truss bracing system of the present invention of FIG. 1 in its unfolded "ready to use" configuration and attached to a pair of trusses.

Referring now to FIGS. 1-7, one preferred embodiment of a truss bracing system 10 of the present invention is shown. The truss bracing system 10 of the present invention comprises of a lateral brace 12 and a diagonal brace 14 connected through a pivot point 16.

The lateral brace 12 includes a first support member 18 and a second support member 20. Preferably, the first support member 18 and a second support member 20 are integral to each other and are constructed from a single piece of material. That is, preferably, the lateral brace 12 is an integral component with the first support member 18 angled relative to the second support member 20. Most preferably, to provide the lateral brace 12 with the greatest level of strength and durability, the first support member 18 and the second support member 20 are perpendicular to each other with the lateral brace 12 either formed with or bent to create the desired ninety degree angle.

Optionally, the lateral brace 12 may also include a third support member that is integral to the first support member 18 and the second support member 20 and which is part of the single piece of material that the lateral brace is made of. The third support member, if used, is angled relative to the first support member 18 and roughly parallel to the second support member 20, with the third support member extending downward from the edge of the first support member 18 opposite the edge from which the second support member 20 extends. For example, to provide the lateral brace 12 with a greater level of strength and durability, the third support member may be perpendicular to the first support member 18 and parallel to the second support member 20 with the lateral brace 12 either formed with or bent to create the desired ninety degree angles between the first support member 18 and both the second support member 20 and the third support member (thereby resulting in a lateral brace 12 with a U-shaped cross-section). However, the optional third support member need not be included as part of the lateral brace 12 for the truss bracing system 10 to fall within the scope of the present invention.

The lateral brace 12 may be constructed of any material that has the desired strength and ease in manufacturing, such as a metal, composite, or high strength plastic. Most preferably, the lateral brace 12 is constructed of steel. For example, the lateral brace 12 may take the form of steel angle material, such as 20 or 22 gauge steel angle. The specific length of the lateral brace 12 is selected based upon the spacing between the trusses with which the truss bracing system 10 will be used. For example, when the truss bracing system 10 will be used with standard spaced trusses, which are separated by 24 inches on center, the lateral brace 12 will have an overall length of approximately 25.45 inches. Any width for the lateral brace 12 that provides sufficient strength and support to the truss bracing system 10 may be utilized. For example, in most circumstances, a width of approximately 1.625 inches is sufficient, with both the first support member 18 and the second support member 20 of the lateral brace 12 having a similar width. However, a variety of lengths and widths may be used for the lateral brace 12 without departing from the scope of the present invention.

Generally the second support member 20 of the lateral brace 12 is shorter in length than the first support member 18, such that the second support member 20 may be located between the two trusses to which the truss bracing system 10 is to be attached, while the first support member 18 extends over the top of the truss to allow the lateral brace 12 (and truss bracing system 10) to be secured to the truss. That is, the second support member 20 is shorter than the first support member 18 so that it does not interfere with securing the lateral brace 12 to the two trusses to which the truss bracing system 10 is to be attached.

The lateral brace 12 also includes an end stop 22 at a first end 24 of the lateral brace 12 which extends downward from the first support member 18 perpendicular to both the first support member 18 and the second support member 20. The end stop 22 provides additional support to the truss bracing system 10 by resting against the outer surface of the truss and providing additional lateral support to the truss bracing system 10 when it is subjected to lateral forces. Preferably, the end stop 22 is integral to the lateral brace 12, specifically to the first support member 18, to provide ease of manufacture and greater strength. However, the end stop 22 may alternatively be attached to the lateral brace 12 with fasteners, adhesives, or similar means.

There is a gap between the end stop 22 and the end of second support member 20 for receiving one of the trusses to which the truss bracing system 10 is to be attached, such that the truss may extend through such gap with the first support member 18 resting on top of the truss and the end stop 22 being located adjacent to the outer surface of the truss.

The first end 24 of the lateral brace 12 includes an aperture 26 for receiving a fastener for securing the lateral brace 12 and the truss bracing system 10 to the first truss to which it is secured. Likewise, a second end 28 of the lateral brace 12 opposite the first end 24 also includes an aperture 30 for receiving a fastener for securing the lateral brace 12 and the truss bracing system 10 to the second truss to which it is secured. Typically, the fasteners take the form of nails, such as 16-Penny framing nails or other similar nails, but any type of fasteners known in the art may alternatively be used to secure the lateral brace 12 and the truss bracing system 10 to the truss. For example, bolts and screws and other such fasteners may alternatively be utilized.

The lateral brace 12 also includes a pivot aperture 32 for receiving the pivot point 16 of the truss bracing system 10. The diagonal brace 14 of the truss bracing system 10 is secured to the lateral brace 12 through the pivot point 16. The pivot aperture 32 is located along the longitudinal centerline of the first support member 18, between the two ends of the lateral brace 12. The specific longitudinal location of the pivot aperture 32 is selected based upon the length of diagonal brace 14 used and the desired angle between the lateral brace 12 and the diagonal brace 14. For example, when the truss bracing system 10 will be used with standard spaced trusses (24 inches on center) and the lateral brace 12 has an overall length of approximately 25.45 inches, and the desired angle for the diagonal brace 14 (having an overall length of 25.55 inches) is forty-five (45) degrees, the pivot aperture 32 is located approximately 9.19 inches from the first end of the lateral brace 12.

The diagonal brace 14 includes a first support member 34 and a second support member 36. Preferably, the first support member 34 and a second support member 36 are integral to each other. That is, preferably, the diagonal brace 14 is an integral component with the first support member 34 angled relative to the second support member 36. Most preferably, to provide the diagonal brace 14 with the greatest level of strength and durability, the first support member 34 and the second support member 36 are perpendicular to each other with the diagonal brace 14 either formed with or bent to create the desired ninety degree angle.

Optionally, the diagonal brace 14 may also include a third support member that is integral to the first support member 34 and the second support member 36 and which is part of the single piece of material that the diagonal brace is made of. The third support member, if used, is angled relative to the first support member 34 and roughly parallel to the second support member 36, with the third support member extending downward from the edge of the first support member 34 opposite the edge from which the second support member 36 extends. For example, to provide the diagonal brace 14 with a greater level of strength and durability, the third support member may be perpendicular to the first support member 34 and parallel to the second support member 36 with the diagonal brace 14 either formed with or bent to create the desired ninety degree angles between the first support member 34 and both the second support member 36 and the third support member (thereby resulting in a diagonal brace 14 with a U-shaped cross-section). However, the optional third support member need not be included as part of the diagonal brace 14 for the truss bracing system 10 to fall within the scope of the present invention.

The diagonal brace 14 may be constructed of any material that has the desired strength and ease in manufacturing, such as a metal, composite, or high strength plastic. Most preferably, the diagonal brace 14 is constructed of steel. For example, the diagonal brace 14 may take the form of metallic or steel angle, such as 20 or 22 gauge steel angle. The specific length of the diagonal brace 14 is selected based upon the spacing between the trusses with which the truss bracing system 10 will be used. For example, when the truss bracing system 10 will be used with standard spaced trusses, which are separated by 24 inches on center, and will have an angle of forty-five degrees from the lateral brace 12, the diagonal brace 14 will have an overall length of approximately 25.55 inches. Any width for the diagonal brace 14 that provides sufficient strength and support to the truss bracing system 10 may be utilized. For example, in most circumstances, a width of approximately 1.625 inches is sufficient, with both the first support member 34 and the second support member 36 of the diagonal brace 14 having a similar width. However, a variety of lengths and widths may be used for the diagonal brace 14 without departing from the scope of the present invention.

Generally the second support member 36 is shorter in length than the first support member 34, such that the second support member 36 ends adjacent to the surface of the truss to which the truss bracing system 10 is to be attached, while the first support member 34 extends over the top of the truss to allow the diagonal brace 14 (and truss bracing system 10) to be secured to the truss. That is, there is a gap between the end of the second support member 36 and the end of the first support member 34 at the end of the diagonal brace 14 closest to the truss to which the truss bracing system 10 is to be attached. However, typically the end of the second support member 36 and the end of the first support member 34 at the end of the diagonal brace 14 closest to the pivot point 16 (and opposite the truss to which the truss bracing system 10 is to be attached) are substantially adjacent to each other to provide a built-in "stop" for the diagonal brace 14 at the desired angle for the diagonal brace 14.

The diagonal brace 14 also includes a pivot aperture 38 for receiving the pivot point 16 of the truss bracing system 10. The pivot aperture 38 is located near a first end 40 of the first support member 34 of the diagonal brace 14 (the end closest to the pivot point 16 and opposite the truss to which the truss bracing system 10 is to be attached) along the longitudinal centerline of the first support member 34.

The diagonal brace 14 also includes an end stop 42 at a second end 44 of the diagonal brace 14 opposite the first end 40 (the end closest to the truss to which the truss bracing system 10 is to be attached) which extends downward from the first support member 34 perpendicular to the first support member 34 and at an angle to the second support member 36. The end stop 42 provides additional support to the truss bracing system 10 and diagonal brace 14 by resting against the outer surface of the truss. The end stop 42 also assists in the proper positioning of the diagonal brace 14 at the desired angle relative to the truss to which the truss bracing system 10 is to be attached.

There is a gap between the end stop 42 and the end of second support member 36, such that the truss may extend through such gap with the first support member 34 resting on top of the truss and the end stop 42 resting adjacent to the outer surface of the truss.

The second end 44 of the diagonal brace 14 also includes an aperture 46 for receiving a fastener for securing the diagonal brace 14 and the truss bracing system 10 to the second truss to which the truss bracing system 10 is to be attached. Typically, the fastener takes the form of a nail, such as a 16-Penny framing nail or other similar nail, but any type of fastener known in the art may alternatively be used to secure the diagonal brace 14 and the truss bracing system 10 to the second truss. For example, bolts and screws and other such fasteners may alternatively be utilized.

Both the first end and second end of the first support member 34 of the diagonal brace 14 have an angled configuration relative to the side edges of the diagonal brace 14 and the second support member 36. The first end 40 of the diagonal brace 14 has an angle that corresponds with the angle of the surface of the second support member 20 of the lateral brace 12 when the diagonal brace 14 is in its extended, ready-to-use configuration. Preferably, to allow the diagonal brace 14 to smoothly rotate from its closed storage configuration to its extended, ready-to-use configuration, the angled portion of the first end 40 of the first support member 34 smoothly curves into the side edge of the first support member 34, rather than the first end 40 meeting the side edge of the first support member 34 at a hard angle. Likewise, the second end of the first support member 34 of the diagonal brace 14 has an angle that corresponds with the outer surface of the second truss to which the diagonal brace 14 and truss bracing system 10 will be secured when the diagonal brace 14 is in its extended, ready-to-use configuration.

The lateral brace 12 and diagonal brace 14 are secured to each other through the pivot point 16. The pivot point 16 allows the diagonal brace 14 to rotate relative to the lateral brace 12, such that the diagonal brace 14 may be angled relative to the lateral brace 12. That is, when the truss bracing system 10 of the present invention is being shipped, sold, or stored, or in any situation where it is desirable to limit or otherwise minimize the space taken up by the truss bracing system 10, the truss bracing system 10 may be held in its storage configuration with the diagonal brace 14 rotated such that it is adjacent to, and parallel with, the lateral brace 12. Then, when the truss bracing system 10 is to be installed, the diagonal brace 14 is shifted to its extended configuration with the second end 44 of the diagonal brace 14 rotated outward and away from the lateral brace 12. By rotating the diagonal brace 14 away from the lateral brace 12, the diagonal brace 14 and the truss bracing system 10 provides the desired diagonal bracing to the trusses to which it is attached.

The pivot point 16 of the truss bracing system 10 extends through the pivot aperture 32 of the lateral brace 12 and the pivot aperture 38 of the diagonal brace 14. Preferably, the pivot point 16 comprises a short metallic cylinder that is extended through the pivot aperture 32 of the lateral brace 12 and the pivot aperture 38 of the diagonal brace 14 and then compressed flat to secure the diagonal brace 14 to the lateral brace 12 while still allowing the diagonal brace 14 to rotate relative to the lateral brace 12. However, alternatively, the pivot point 16 may take the form of any type of pivot fastener known in the art, such as a rivet, pivot pin, or other similar fastener without departing from the scope of the present invention.

The truss bracing system 10 of the present invention will be ready to be used when the builder or other end user has begun securing the trusses with which the truss bracing system 10 will be used to the top of the building frame. After at least two trusses have been secured to the building frame, the truss bracing system 10 may be attached. Then, as more trusses are secured to the building frame, additional truss bracing systems 10 may be installed as the builder progresses with the installation trusses across the building frame.

The builder begins by removing the truss bracing system 10 from any packaging in which the truss bracing system 10 was sold or shipped, at which point the truss bracing system 10 will be in its closed storage configuration with the diagonal brace 14 lying adjacent to the lateral brace 12. The diagonal brace 14 is then extended to its open, ready-to-use configuration by rotating the second end 44 of the diagonal brace 14 away from the lateral brace 12, such that the diagonal brace 14 rotates around the pivot point 16 of the truss bracing system 10. When the diagonal brace 14 reaches its open, ready-to-use configuration, the second support member 36 of the diagonal brace 14 will come into contact with the second support member 20 of the lateral brace 12 and will be prevented from rotating further. When the open, ready-to-use position is reached, the diagonal brace 14 will be angled relative to the lateral brace 12.

The lateral brace 12 of the truss bracing system 10 is then placed over two adjacent trusses. The end stop 22 of the lateral brace 12 is positioned such that it is resting adjacent to the outer surface of the first truss. The first support member 18 of the lateral brace 12 is then positioned so that it is resting on top of the first and second trusses. When the lateral brace 12 is in the correct position, the second support member 20 of the lateral brace 12 will extend between the first and second trusses.

As the lateral brace 12 is moved into the correct position, the diagonal brace 14 of the truss bracing system 10 is placed over the second truss. The diagonal brace 14 is positioned so that the end stop 42 of the diagonal brace 14 is adjacent to the outer surface of the second truss and the first support member 34 of the diagonal brace 14 resting on top of the second truss. When the diagonal brace 14 is in the correct position, the second support member 36 of the diagonal brace 14 will extend between the second truss and the second support member 20 of the lateral brace 12.

Once both the lateral brace 12 and the diagonal brace 14 are in the proper positions, the truss bracing system 10 is secured to the first and second trusses by extending nails, or other fasteners, through the fastener apertures 26, 30 of the lateral brace 12 and the fastener aperture 46 of the diagonal brace 14 and driving the fasteners into the wood of each truss.

As additional trusses are installed, additional truss bracing systems 10 are attached between the last truss and the newly installed truss using the same procedure outlined above. The specific positions of the series of truss bracing systems 10, as well as the overall configuration of the truss bracing systems 10, are determined in accordance with local building codes and other safety codes. Typically, there will be a series of truss bracing systems 10 mounted substantially in a lateral line across the trusses and then another series of truss bracing systems 10 are mounted at a diagonal angle across the trusses, such that the two lines cross at an angle on the surface of the trusses. However, any positions, and overall configurations, of the truss bracing systems 10 that meets recommended building and safety codes may be utilized.

After the truss bracing systems 10 have been attached to the trusses, the builder may safely install the roof sheathing right over the top of the truss bracing systems 10 due to their low profile configuration relative to the surface of the trusses without adversely impacting the roof sheathing. That said, if the builder desires to remove the truss bracing systems 10 from the trusses as roof sheathing is installed for reuse, the builder may do so—provided that by doing so, the builder is foregoing some of the benefits of the truss bracing system 10 of the present invention.

It will be recognized by one skilled in the art that the size, configuration, or dimensions of the truss bracing system 10 of the present invention may be adjusted to allow for use with various sizes and configurations of trusses, such as roof trusses and other types of trusses, as may be desired by the end user. Likewise, it will be recognized by one skilled in the art that the materials from which the truss bracing system 10 of the present invention is made may be varied without departing from the scope of the present invention.

While the invention has been described in the specification and illustrated in the drawings with reference to certain preferred embodiments, it will be understood by those skilled in the art that various changes may be made and equivalents may be substituted for elements thereof without departing from the scope of the present invention. In addition, many modifications may be made to adapt to a particular situation or material to the teachings of the invention without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the invention herein.

What is claimed is:

1. A truss bracing system comprising:

(a) a lateral brace, wherein the lateral brace comprises a first support member and a second support member, the second support member of the lateral brace is shorter than the first support member of the lateral brace, the first support member has a first end and a second end, and an end stop extends downward from the second end of the first support member;

(b) a diagonal brace, wherein the diagonal brace comprises a first support member and a second support member, the second support member of the diagonal brace is shorter than the first support member of the diagonal brace, the first support member has a first end and a second end, and an end stop extends downward from the second end of the first support member; and (c) a pivot point permanently securing the first support member of the lateral brace to the first end of the first support member of the diagonal brace, wherein the diagonal brace rotates relative to the lateral brace about the pivot point and the first end of the first support member of the diagonal brace contacts the second support member of the lateral brace when the diagonal brace reaches a predetermined angle to the lateral brace and defines a rotational stop for the diagonal brace.

2. The truss bracing system of claim 1, wherein the end stop of the first support member of the lateral brace is perpendicular to the first support member of the lateral brace and is perpendicular to the second support member of the lateral brace.

3. The truss bracing system of claim 2, wherein the second support member of the lateral brace includes a first end and a second end and the end stop of the first support member of the lateral brace is offset from the first end of the second support member of the lateral brace, such that the end stop of the lateral brace and the second support member of the lateral brace define define a gap for receiving a truss.

4. The truss bracing system of claim 1, wherein the first support member and the second support member of the lateral brace are integral to each other and the first support member and the second support member of the diagonal brace are integral to each other.

5. The truss bracing system of claim 1, wherein the first support member and the second support member of the lateral brace are angled relative to each other and the first support member and the second support member of the diagonal brace are angled relative to each other.

6. The truss bracing system of claim 5, wherein the first support member of the lateral brace is perpendicular to the second support member of the lateral brace and the first support member of the diagonal brace is perpendicular to the second support member of the diagonal brace.

7. The truss bracing system of claim 1, wherein the end stop of the first support member of the diagonal brace is perpendicular to the first support member of the diagonal brace and is perpendicular to the second support member of the diagonal brace.

8. The truss bracing system of claim 7, wherein the second support member of the diagonal brace includes a first end and a second end and the end stop of the first support member of the diagonal brace is offset from the second end of the second support member of the diagonal brace, such that the end stop of the diagonal brace and the second support member of the diagonal brace define define a gat for receiving a truss.

9. The truss bracing system of claim 1, wherein the lateral brace defines a first pivot point aperture and the diagonal brace defines a second pivot point aperture.

10. The truss bracing system of claim 9, wherein a pivot pin extends through the first pivot aperture of the lateral brace and the second pivot aperture of the diagonal brace to form the pivot point.

11. The truss bracing system of claim 10, wherein the pivot pin comprises a fastener.

12. The truss bracing system of claim 11, wherein the pivot pin comprises a hollow cylindrical pin.

13. The truss bracing system of claim 12, wherein the hollow cylindrical pin is flattened at each end to secure the pivot pin to the lateral brace and the diagonal brace.

14. The truss bracing system of claim 11, wherein the pivot pin is a rivet.

15. The truss bracing system of claim 1, the second support member of the lateral brace includes a first end and a second end and the end step of the first support member of the lateral brace is offset from an end of the second support member of the lateral brace, such that the end stop of the lateral brace and the second support member of the lateral brace define define a gap for receiving a first truss, and the second support member of the diagonal brace includes a first end and a second end and the end stop of the first support member of the diagonal brace is offset from an end of the second support member of the diagonal brace, such that the end stop of the diagonal brace and the second support member of the diagonal brace define a gap for receiving a second truss.

16. The truss bracing system of claim 1, wherein the lateral brace includes at least one fastener aperture for receiving at least one fastener to secure the truss bracing system to at least one truss.

17. The truss bracing system of claim 1, wherein the diagonal brace includes at least one fastener aperture for receiving at least one fastener to secure the truss bracing system to at least one truss.

18. The truss bracing system of claim 1, wherein the lateral brace includes at least one fastener aperture for receiving at least one fastener to secure the truss bracing system to at least one truss and the diagonal brace includes at least one fastener aperture for receiving at least one fastener to secure the truss bracing system to at least one truss.

19. The truss bracing system of claim 1, where the truss bracing system is constructed of a metal.

20. The truss bracing system of claim 19, wherein the truss bracing system is constructed of steel.

* * * * *